US005930560A

United States Patent [19]

Sawaki

[11] Patent Number: 5,930,560

[45] Date of Patent: Jul. 27, 1999

[54] IMAGE FORMING APPARATUS

[75] Inventor: Yukichi Sawaki, Nagoya, Japan

[73] Assignee: Brother Kogyo Kabushiki Kaisha, Nagoya, Japan

[21] Appl. No.: 08/914,173

[22] Filed: Aug. 19, 1997

[30] Foreign Application Priority Data

Aug. 21, 1996 [JP] Japan ..... 8-219554

[51] Int. Cl.[6] ..... G03G 21/16

[52] U.S. Cl. ..... 399/111; 399/411; 361/225

[58] Field of Search ..... 399/111, 124, 399/125, 411, 117; 361/212, 225

[56] References Cited

U.S. PATENT DOCUMENTS 5,345,294 9/1994 Nomura et al. .

5,585,889 12/1996 Shishido et al. .

5,669,042 9/1997 Kobayashi et al. ..... 399/111

5,689,774 11/1997 Shishido et al. ..... 399/111

5,752,131 5/1998 Fujiwara et al. ..... 399/111 X

*Primary Examiner*—R. L. Moses

*Attorney, Agent, or Firm*—Oliff & Berridge, PLC

[57] ABSTRACT

An image forming apparatus includes a machine body provided with a cartridge mounting portion, and a process cartridge removably mounted in the machine body for forming images on a recording paper. The process cartridge is provided with a first terminal, whereas the machine body is provided with a second terminal for contact with the first terminal when the process cartridge is loaded at the cartridge mounting portion. Further, the machine body is also provided with a charge removing member which comes into contact with the first terminal when the process cartridge is mounted at the cartridge mounting portion but before the first terminal comes into contact with the second terminal.

20 Claims, 4 Drawing Sheets

IMAGE FORMING APPARATUS

BACKGROUND OF THE INVENTION

1. Field of the Invention

The present invention relates to an image forming apparatus such as a printer, a photocopying machine, or a printing unit of a facsimile machine or of a multi-function device. More particularly, the present invention relates to an image forming apparatus of the type which incorporates a removable process cartridge including a photosensitive drum together with associated components necessary for electrophotography.

2. Description of the Related Art

Typically, a prior art image forming apparatus such as a printer or a photocopying machine incorporates various electrophotographic components (e.g. a photosensitive drum, a toner cartridge) in a single module called "process cartridge" for facilitating replacement. In operation, recording papers are successively guided to pass through the process cartridge for printing by transferring toner images on the photosensitive drum to the recording paper.

With the image forming apparatus of the type described above, a paper jam sometimes occurs if a recording paper is warped or if a plurality of recording papers erroneously supplied to the process cartridge at the same time. For eliminating such a paper jam, the user need to first remove the process cartridge from the machine body and then remove the jammed paper from the process cartridge. After elimination of the paper jam, the process cartridge may be reloaded into the machine body.

The need for eliminating the paper jam and for reloading the process cartridge may cause the following problems.

At the time of removing the jammed paper, the process cartridge may be electrostatically charged due to friction, and the amount of the electrostatic charge increases with an increase of the paper clamping force exerted between the photosensitive drum and a paper feed roller. However, no measure has been conventionally taken to preliminarily remove the electrostatic charge from the process cartridge at the time of reloading it into the machine body.

On the other hand, the process cartridge is provided with a first group of connection terminals for power supply and grounding, whereas the machine body is provided with a second group of connection terminals for the same purposes. Thus, when the process cartridge having been previously charged electrostatically is reloaded into the machine body, an abrupt discharge may occur when the first group connection terminals approach the second group connection terminals, which may cause damage to the electronic circuitry of the image forming apparatus and/or malfunction of the circuitry. Further, even if an abrupt discharge does not occur, the electrostatic charge will ultimately flows into the electronic circuitry, thereby adversely affecting the circuitry.

SUMMARY OF THE INVENTION

It is, therefore, an object of the present invention is to provide an image forming apparatus which eliminates or reduces the above-described problems of the prior art.

According to one aspect of the present invention, there is provided an image forming apparatus comprising: a machine body provided with a cartridge mounting portion; a process cartridge removably mounted at the cartridge mounting portion for forming images on a recording paper; a first terminal provided on the process cartridge; a second terminal provided on the machine body for contact with the first terminal when the process cartridge is loaded at the cartridge mounting portion; and a charge removing member provided on one of the machine body and the process cartridge, the charge removing member discharging an electrostatic charge from the process cartridge when the process cartridge is mounted at the cartridge mounting portion but before the first terminal comes into contact with the second terminal.

With the above-described design, an electrostatic charge of the process cartridge resulting at the time of removing a jammed paper or papers from the cartridge may be allowed to escape through the charge removing member before the first terminal comes into contact with the second terminal. Thus, unlike the prior art image forming apparatus, it is possible to prevent occurrence of noises due to an electrostatic discharge between the first and second terminals while also preventing flow of a large current into the electronic circuitry of the machine body. As a result, the electronic circuitry of the machine body can be reliably protected, and the image forming apparatus is unlikely to undergo an erroneous operation or malfunction.

In a preferred embodiment of the present invention, the machine body comprises a guide portion for guiding the first terminal when the process cartridge is mounted at the cartridge mounting portion, and the charge removing member is provided on the machine body in a travel path of the first terminal for contact therewith before the first terminal comes into contact with the second terminal. Such a design will reliably bring the first terminal into contact with the charge removing member for reliable elimination of an electrostatic charge from the process cartridge.

Preferably, the guide portion is formed to guide the first terminal downward to enable downward loading of the process cartridge into the cartridge mounting portion. In this case, the charge removing member need be positioned above the second terminal to make sure that the first terminal comes into contact with the charge removing member before coming into contact with the second terminal. It is even more preferable if the guide portion is formed to guide the first terminal obliquely because the process cartridge can be most conveniently loaded into the machine body when a top cover of the machine body is pivoted open.

The guide portion may preferably comprise a guide groove formed in a wall of the cartridge mounting portion, so that the first terminal fits and slides in the guide groove.

It is advantageous if the charge removing member comprises a charge removing brush mounted on the machine body to project into the guide groove and connected to a grounding terminal provided on the machine body. Such a design will allow the first terminal to come into repetitive contact with the brush without much damage even if the process cartridge is frequently taken out and reloaded.

In another preferred embodiment of the present invention, the charge removing member is provided on the process cartridge for contact with a grounding terminal of the machine body when the process cartridge is mounted at the cartridge mounting portion but before the first terminal comes into contact with the second terminal. In this case, again, the charge removing member may preferably comprise a charge removing brush.

According to another aspect of the present invention, there is provided an image forming apparatus comprising: a machine body provided with a cartridge mounting portion; a process cartridge removably mounted at the cartridge mounting portion for forming images on a recording paper; a first terminal provided on the process cartridge; a second terminal provided on the machine body for contact with the first terminal when the process cartridge is loaded at the cartridge mounting portion; and a charge removing member provided on the machine body for contact with the first terminal when the process cartridge is mounted at the cartridge mounting portion but before the first terminal comes into contact with the second terminal.

According to a further aspect of the present invention, there is provided an image forming apparatus comprising: a machine body provided with a cartridge mounting portion; a process cartridge removably mounted at the cartridge mounting portion for forming images on a recording paper; a first terminal provided on the process cartridge; a second terminal provided on the machine body for contact with the first terminal when the process cartridge is loaded at the cartridge mounting portion; and a charge removing member provided on the process cartridge for contact with a selected conductive portion of the machine body when the process cartridge is mounted at the cartridge mounting portion but before the first terminal comes into contact with the second terminal.

Other objects, features and advantages of the present invention will be apparent from the detailed description of a preferred embodiments given below with reference to the accompanying drawings.

DETAILED DESCRIPTION OF THE PREFERRED EMBODIMENTS

The preferred embodiments of the present invention will be described below with reference to the accompanying drawings.

Figure 1:
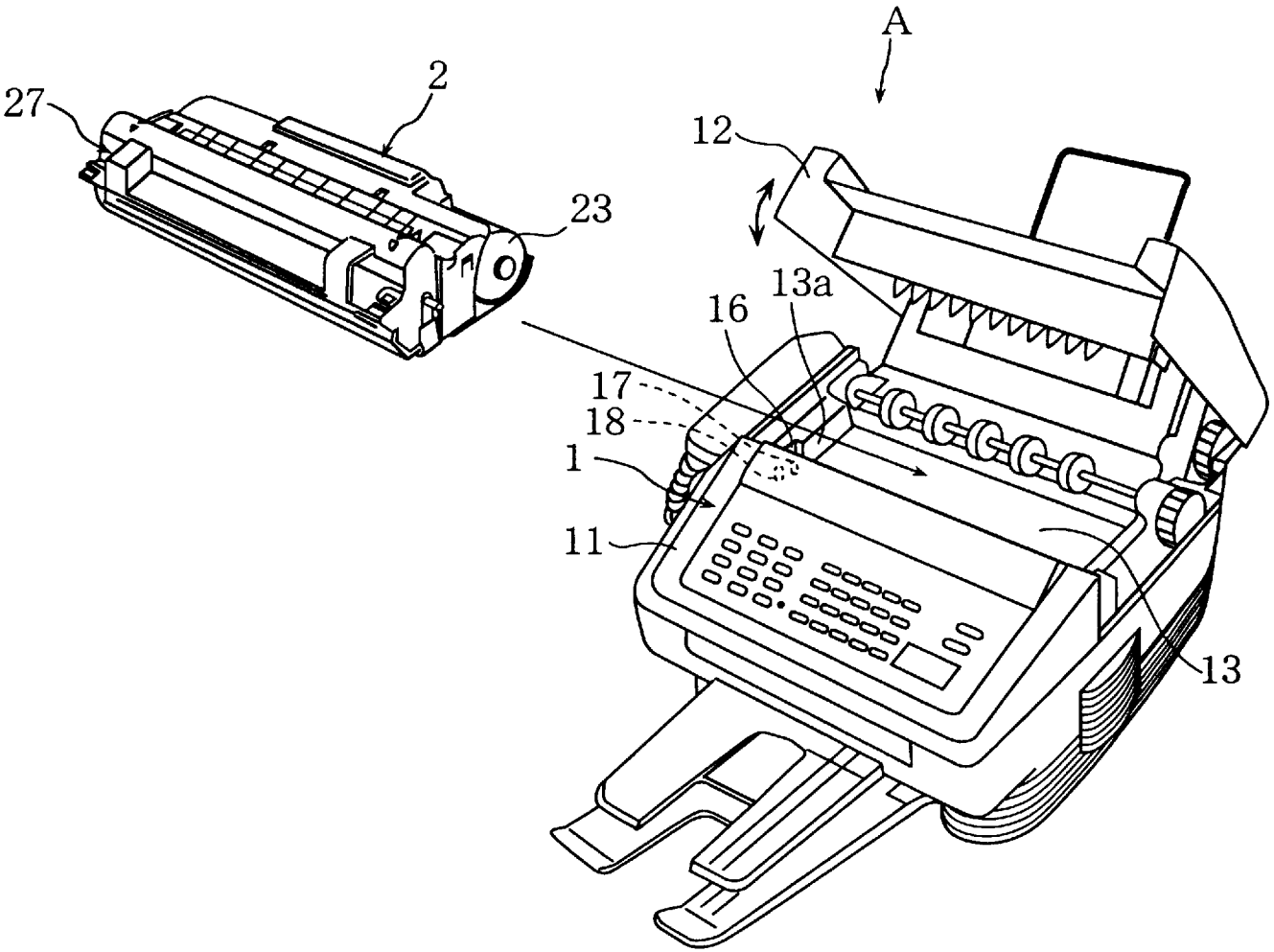
FIG. 1 is a perspective view showing an image forming apparatus embodied as a multi-function device in accordance with the present invention.

Reference is first made to FIG. 1 illustrating an image forming apparatus A embodied as a multi-function device which has a printer function and a facsimile function under the control of a personal computer (not shown) connected to the multi-function device. Having nothing to do with the gist of the present invention, the facsimile function of the multi-function device A and its connection to the personal computer are not described.

The multi-function device A comprises a machine body 1 which includes a main housing 11 and a top cover 12 pivotally connected to the main housing 11 for opening and closing. The machine body 1 also has a recessed cartridge mounting portion 13 for removably receiving a process cartridge 2 (also referred to as "drum cartridge") when the top cover 12 is opened.

Figure 2:
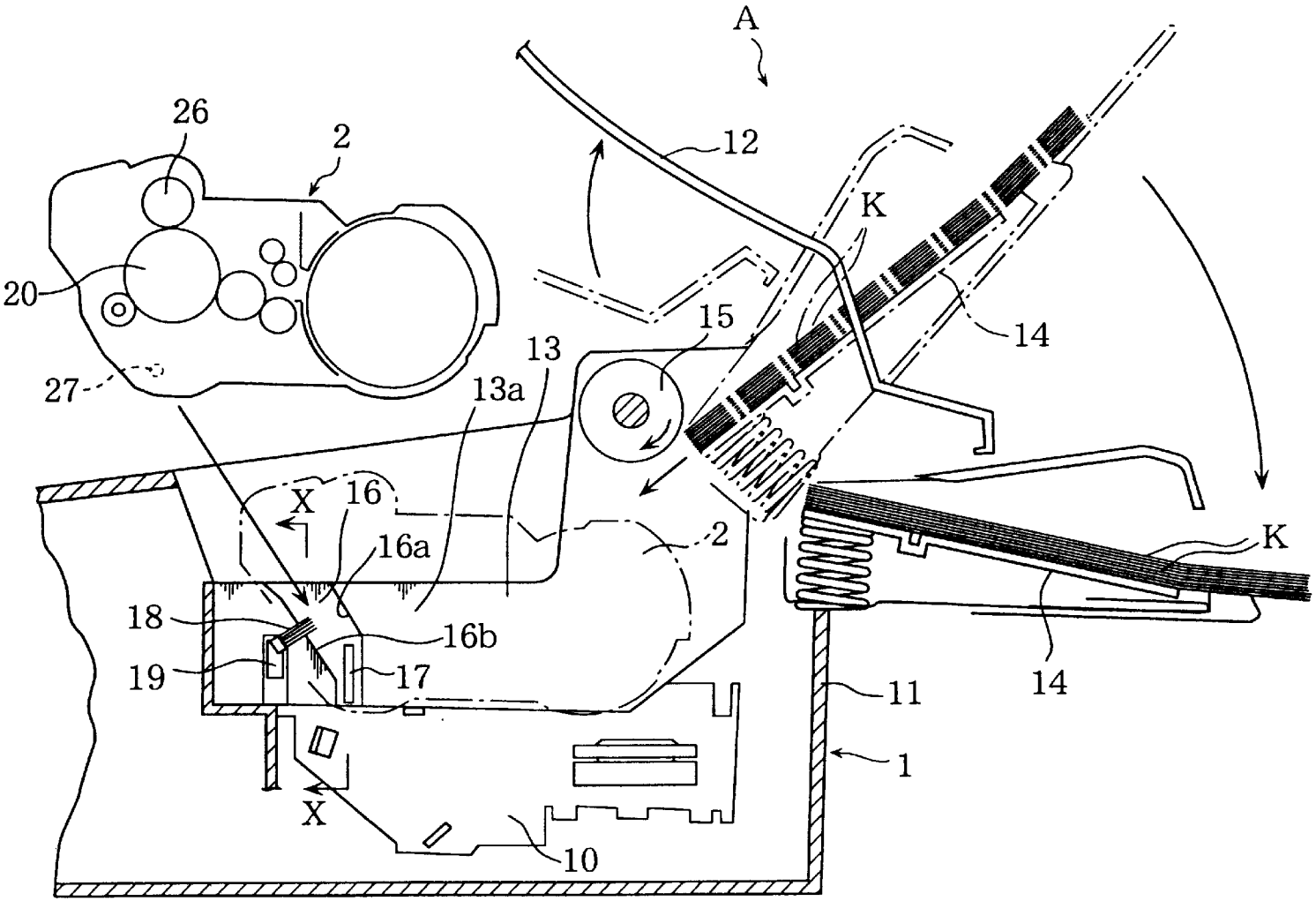
FIG. 2 is an enlarged fragmentary side view, partly in vertical section, showing the same multi-function device.

As shown in FIG. 2, the top cover 12 is provided with a paper receiver 14 for receiving a stack of recording papers K, as shown in FIG. 2. When the top cover 12 is closed, the uppermost one of the stacked recording papers K comes into contact with a paper feed roller 15 which rotates for successively feeding the recording papers K toward the process cartridge 2, as indicated by phantom lines in FIG. 2.

Though not shown in the drawings, the machine body 1 further incorporates drive mechanisms, transmission mechanisms, a central process unit and other electronic devices required for operating the various components (e.g. the process cartridge 2 and the paper feed roller 15) of the mult-function device A.

Figure 4:
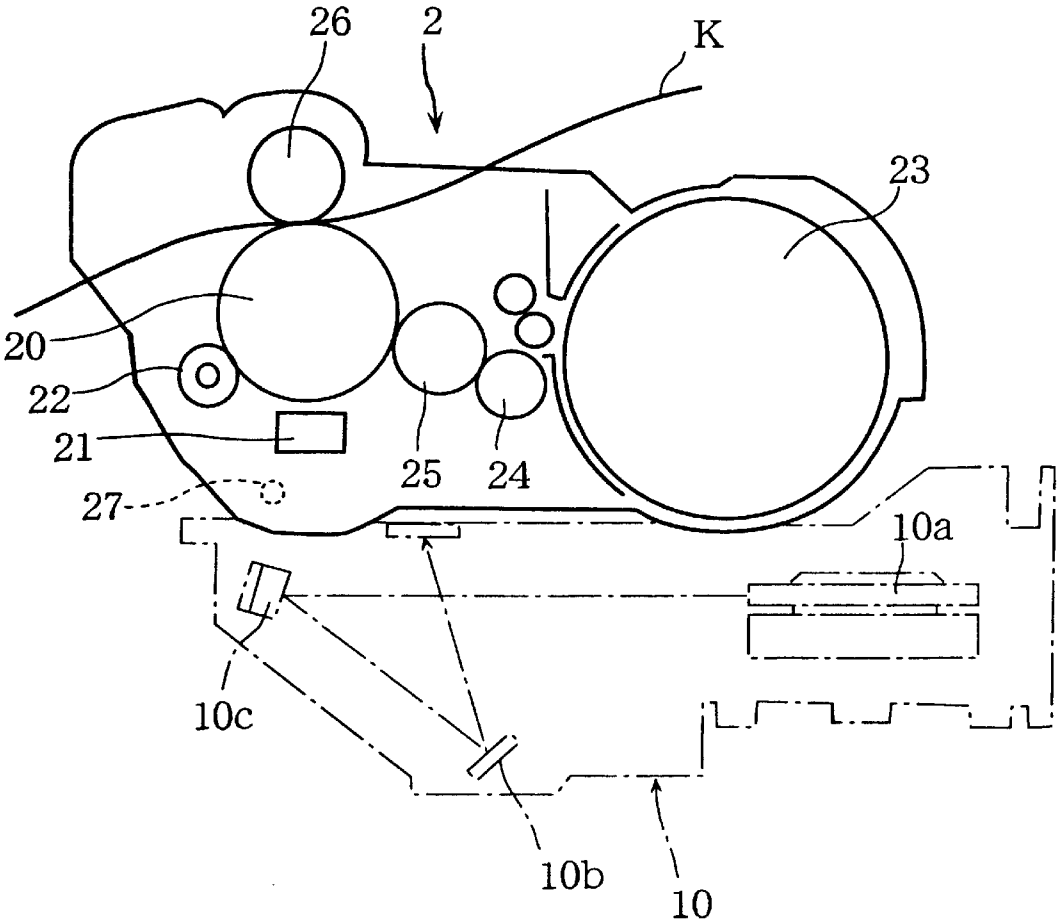
FIG. 4 is an enlarged schematic side view illustrating a process cartridge and a laser irradiating unit incorporated in the same multi-function device.

The process cartridge 2 includes all or main components necessary for forming images by electrophotography. As shown in FIG. 4, the process cartridge 2 typically includes a photosensitive drum 20, an electrostatic charger 21, a cleaner 22, a toner cartridge 23, a toner supply roller 24, a developing roller 25, and a paper feed roller 26. In the illustrated embodiment, the process cartridge 2 is provided separately from a laser irradiating unit 10 which is incorporated in the machine body 10 under the cartridge mounting portion 13 (see FIG. 2).

The laser irradiating unit 10 includes a polygon mirror 10*a* for scanning a laser beam which is generated by a laser generating device (not shown) and which has passed through a light modulator (not shown). The laser irradiating unit 10 also includes deflection mirrors 10*b*, 10*c* for directing the scanning laser beam toward the photosensitive drum 20 of the process cartridge 2.

The process cartridge 2 combined with the laser irradiating unit 10 performs the process steps of electrostatically charging the photosensitive drum 20 by means of the electrostatic charger 21, exposing the circumferential surface of the photosensitive drum 20 with the light from the laser irradiating unit 10 to form electrostatic latent images, developing the latent images on the photosensitive drum 20 by deposition of toner, and transferring the developed toner images onto a recording paper K fed in between the photosensitive drum 20 and the paper feed roller 26 (see FIG. 4). Though not shown in the drawings, the machine body 1 incorporates a fixing unit for fixing the transferred toner images on the recording paper K.

The process cartridge 2 is provided with a first group of connection terminals. Only one of the first group connection terminals, which is designated by reference numeral 27, is shown in FIGS. 1 through 4. For the convenience of the following description, this connection terminal is hereinafter referred to as "first drum grounding terminal".

The first drum grounding terminal 27 is provided in the form of a pin projecting horizontally from an end surface of the process cartridge 2 for grounding the photosensitive drum 20. The other ones (not shown) of the first group connection terminals are used for supplying drive power to the photosensitive drum 20, the electrostatic charger 21, the cleaner 22, the toner cartridge 23, the toner supply roller 24, the developing roller 25, the paper feed roller 26 and other related components of the process cartridge 2, and for grounding purposes.

Figure 3:
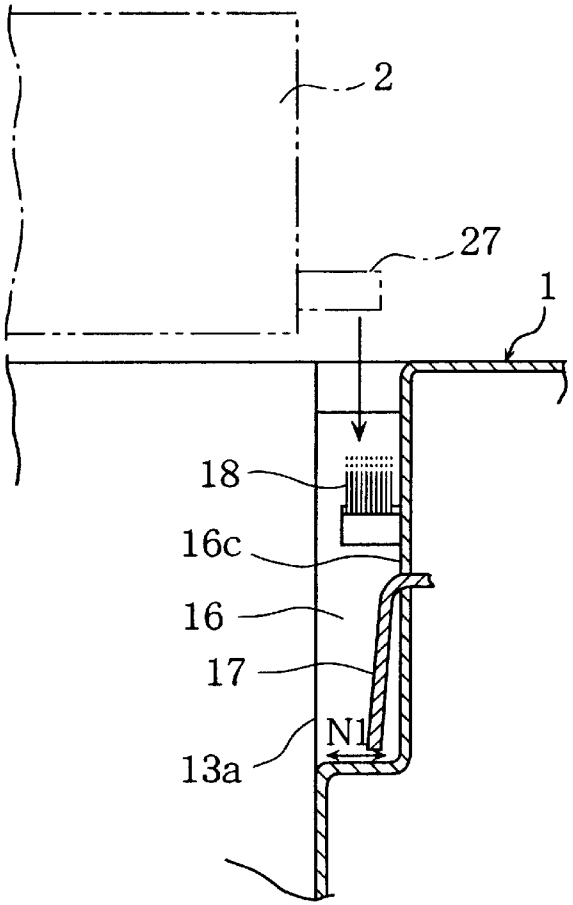
FIG. 3 is an enlarged fragmentary rear view, partly in vertical section, showing a principal portion of the same multi-function device.

The cartridge mounting portion 13 is provided with a second group of connection terminals in corresponding relation to the first group of connection terminals. Only one of the second group connection terminals, which is designated by reference numeral 17, is shown in FIGS. 1 through 3. For the convenience of the following description, this connection terminal is hereinafter referred to as "second drum grounding terminal".

The second drum grounding terminal 17 comes into contact with the first drum grounding terminal 27 for grounding the photosensitive drum 20. The other ones (not shown) of the second group connection terminals are connected to an electronic circuit board (not shown) for supplying drive power to the photosensitive drum 20, the electrostatic charger 21, the cleaner 22, the toner cartridge 23, the toner supply roller 24, the developing roller 25, the paper feed roller 26 and other related components of the process cartridge 2, and for grounding purposes.

As better shown in FIGS. 2 and 3, the cartridge mounting portion 13 has a side wall 13*a* which is formed with a guide groove 16. The second drum grounding terminal 17 is provided in the guide groove 16. Further, the guide groove 16 is also provided with a charge removing brush 18 which is positioned above the second drum grounding terminal 17.

The guide groove 16 is defined by a pair of side walls 16*a*, 16*b* and a bottom wall 16*c*. Each of the side walls 16*a*, 16*b* is inclined downwardly toward the rear of the multi-function device A, as shown in FIG. 2. The second drum grounding terminal 17, which is in the form of an elastic metal plate 17, penetrates through the bottom wall 16*c* to project downwardly into the guide groove 16, as shown in FIG. 3. Thus, the second drum grounding terminal 17 is elastically deformable to reliably come into contact with the first drum grounding terminal 27, as indicated by a double-headed arrow N1 in FIG. 3.

The guide groove 16 is used for guiding the first drum grounding terminal 27 when the process cartridge 2 is loaded into the recessed cartridge mounting portion 13 of the machine body 1. Specifically, when the process cartridge 2 is loaded downwardly into the machine body 1 through the open top cover 12 from above, the first drum grounding terminal 27 fits into the guide groove 16 and is guided obliquely downward by the inclined side walls 16*a*, 16*b* of the guide groove 16.

At the time of loading the process cartridge 2 into the machine body 1, since the charge removing brush 18 is located above the second drum grounding terminal 17, the first drum grounding terminal 17 first comes into contact with the charge removing brush 18 and then comes into contact with the second drum grounding terminal 17. The technical advantage of such an arrangement will be described hereinafter. Further, the first and second groups of connection terminals are arranged such that the first drum grounding terminal 27 comes into contact with the second drum grounding terminal 17 before the other ones of the first group connection terminals come into contact with the corresponding ones of the second group connection terminals.

The charge removing brush 18 has a plurality of electrostatically conductive, flexible bristles providing a total electric resistance of e.g. 1–100 KΩ which is relatively high. The charge removing brush 18 is connected to a grounding terminal 19 provided in the machine body 1 separately from the second drum grounding terminal 17, as illustrated in FIG. 2.

The multi-function device A described above operates in the following manner.

Normally, the process cartridge 2 is loaded in the recessed cartridge mounting portion 13 of the machine body 1. For printing in this condition, the recording papers K stacked on the paper receiver 14 are successively supplied by the paper feed roller 15 to the position in between the photosensitive roller 20 and the paper feed roller 26. The printing operation may be repeated as long as the recording papers K are appropriately supplied.

However, paper jamming may occur between the photosensitive drum 20 and the paper feed roller 26 if the supplied paper is warped or if two or more papers are supplied together. When such paper jamming occurs, the user need only to remove the process cartridge 2 from the machine body 1 for pulling out the jammed paper or papers. At this time, the process cartridge 2 may be electrostatically charged due to friction between the jammed papers K or between the jammed paper(s) K and the process cartridge 2.

After eliminating the paper jamming, the user needs to reload the process cartridge 2 into the machine body 1. As the process cartridge 2 approaches the recessed cartridge mounting portion 13, the first drum grounding terminal 27 of the process cartridge 2 fits in the guide groove 16. As previously described, the first drum grounding terminal 27 comes into contact with the charge removing brush 18 before coming into contact with the second drum grounding terminal 17.

In this way, even if the process cartridge 2 is electrostatically charged, the electrostatic charge is allowed to escape through the charge removing brush 18 and is therefore prevented from flowing through the second drum grounding terminal 17. As previously described, since the total resistance of the charge removing brush 18 is relatively large, an abrupt discharge of the electrostatic charge will not occur upon contact between the first drum grounding terminal 27 and the charge removing brush 18. Thus, it is possible to prevent occurrence of noises resulting from the electrostatic charge of the process cartridge 2. Further, since the charge removing brush 18 is connected to the grounding terminal 19 provided separately from the second drum grounding terminal 27, the electrostatic charge escaping through the charge removing brush 18 and the grounding terminal 19 will not adversely affect the electronic circuits (not shown) associated with the second drum grounding terminal 17. As a result, the electronic circuits or devices incorporated in the machine body 1 will not be subjected to failure or malfunction due to the electrostatic charge of the process cartridge 1.

In the illustrated embodiment, the charge removing brush 18 is provided in the guide groove 16 which guides the first drum grounding terminal 27, so that the first drum grounding terminal 27 can be reliably brought into contact with the charge removing brush 18. Of course, the guide groove 16 may be replaced by any other guide means or may be simply omitted. Further, the guide groove 16 or other guide means may be made to extend vertically for allow vertically downward loading of the process cartridge 2, in which case the charge removing brush 18 is positioned vertically above the second drum grounding terminal 17.

According to the illustrated embodiment, only the first drum grounding terminal 27 of the process cartridge 2 comes into contact with the charge removing brush 18. However, another of the first group connection terminals (not shown) may be made to come into contact with a corresponding charge removing brush (not shown). Alternatively, plural ones of the first group connection terminals (not shown) may come into contact with a plurality of correspondingly located charge removing brushes (not shown).

In the illustrated embodiment, when the process cartridge 2 is loaded into the machine body 1, the first drum grounding terminal 27 first comes into contact with the charge removing brush 18 and then with the second drum grounding terminal 17 before the other ones of the first group connection terminals (not shown) come into the corresponding ones of the second group connection terminals (not shown). However, all of the first group connection terminals may simultaneously come into contact with all of the second group connection terminals, in which case any selected one or ones of the first group connection terminals come into contact with a correspondingly positioned charge removing brush or brushes.

Figure 5:
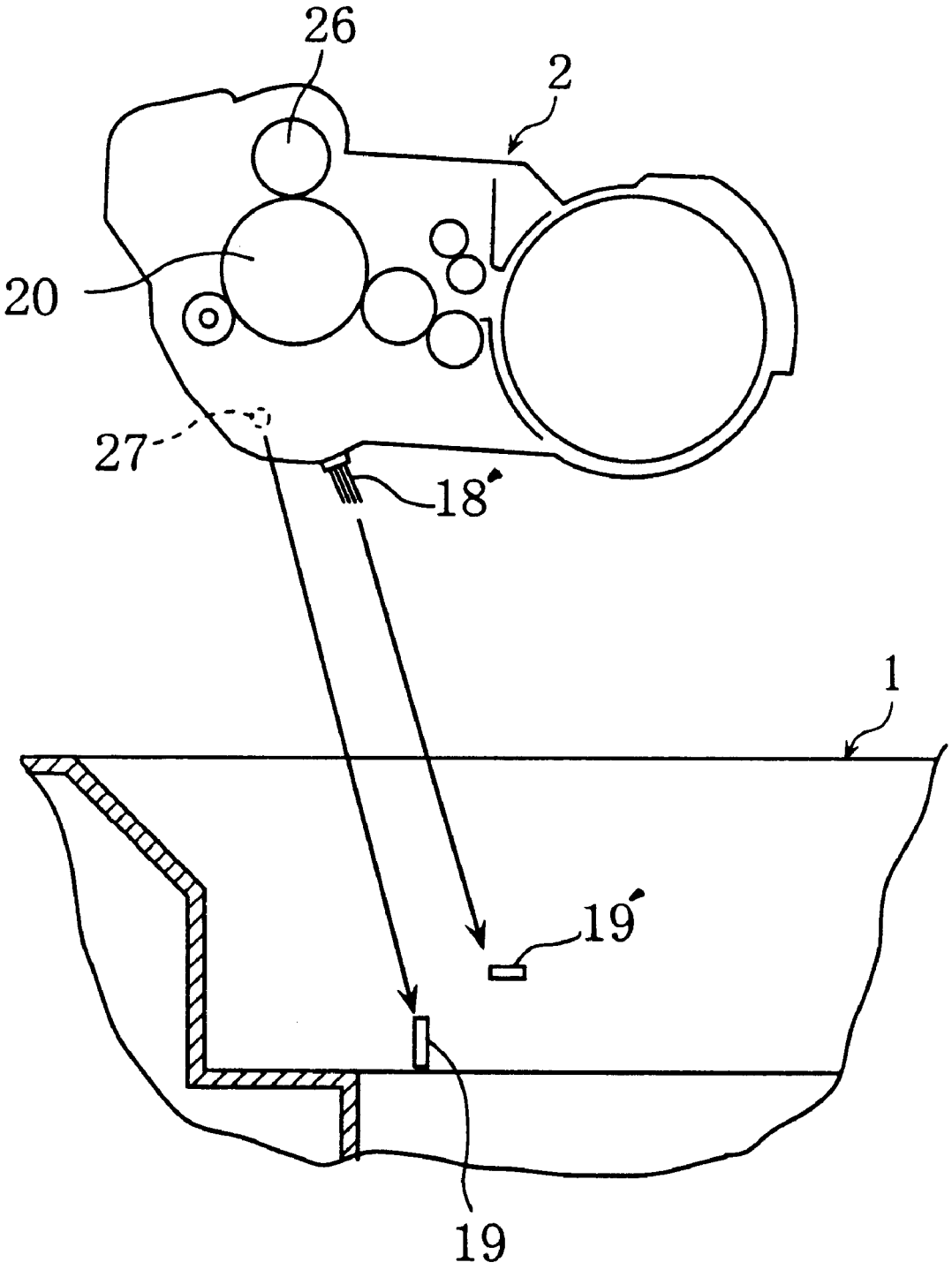
FIG. 5 is a fragmentary side view schematically showing a principal portion of another image forming apparatus embodying the present invention.

FIG. 5 illustrates a modified image forming apparatus embodying the present invention. This embodiment or modification differs basically from the foregoing embodiment in that a charge removing brush 18' is provided on the process cartridge 2 for coming into contact with a grounding terminal 19' of the machine body 1 before the first drum grounding terminal 27 comes into contact with the second drum grounding terminal 17. Though not illustrated in FIG. 5, a guide groove or any other guide means may be provided for guiding the first drum grounding terminal 27 obliquely downward when the process cartridge 2 is loaded into the machine body 1, and the charge removing brush 18' may move in the guide groove for contact with the grounding terminal 19' which may also be located in the guide groove.

Like the foregoing embodiment, the electrostatic charge of the process cartridge 2 may be removed by prior contact between the charge removing brush 18' and the grounding terminal 19' at the time of loading the process cartridge 2 into the machine body 1. Further, an abrupt discharge may be prevented by making the total resistance of the charge removing brush 18' relatively high.

As appreciated from the two embodiments described above, the charge removing brush 18 (18') may be provided either on the machine body 1 or the process cartridge 2. Further, in case where the charge removing brush 18' is provided on the process cartridge 2, it may be brought into contact with any suitably conductive portion of the machine body (other than the grounding terminal 19') which does not cause an adverse influence on the electronic circuitry inside the machine body 1.

In addition to the multi-function device A, the present invention may be also applied to a mono-functional image forming apparatus such as a printer, a photocopying machine, or the printing unit of a facsimile machine. Further, the specific configuration of the process cartridge 2 is not at all limitative. Moreover, while the present invention is intended to remove an electrostatic charge which accumulates on the process cartridge 2 at the time of removing a jammed paper or papers, it is also effective for removing an otherwise occurring electrostatic charge.

The present invention being thus described, it is obvious that the same may be varied in many other ways. For instance, the charge removing brush 18 (18') may be replaced with any other charge removing element. Such variations should not be regarded as a departure from the spirit and scope of the present invention, and all such modifications as would be obvious to those skilled in the art are intended to be included within the scope of the following claims.

I claim:

1. An image forming apparatus comprising:

a machine body provided with a cartridge mounting portion;

a process cartridge removably mounted at the cartridge mounting portion for forming images on a recording paper;

a first terminal provided on the process cartridge;

a second terminal provided on the machine body for contact with the first terminal when the process cartridge is loaded at the cartridge mounting portion; and a charge removing member provided on one of the machine body and the process cartridge, the charge removing member discharging an electrostatic charge from the process cartridge when the process cartridge is mounted at the cartridge mounting portion but before the first terminal comes into contact with the second terminal.

2. The image forming apparatus according to claim 1, wherein the machine body comprises a guide portion for guiding the first terminal when the process cartridge is mounted at the cartridge mounting portion, the charge removing member being provided on the machine body in a travel path of the first terminal for contact therewith before the first terminal comes into contact with the second terminal.

3. The image forming apparatus according to claim 2, wherein the guide portion is formed to guide the first terminal downward when the process cartridge is mounted at the cartridge mounting portion, the charge removing member being positioned above the second terminal.

4. The image forming apparatus according to claim 2, wherein the guide portion is formed to guide the first terminal obliquely downward when the process cartridge is mounted at the cartridge mounting portion, the charge removing member being positioned above the second terminal.

5. The image forming apparatus according to claim 2, wherein the guide portion comprises a guide groove formed in a wall of the cartridge mounting portion.

6. The image forming apparatus according to claim 5, wherein the charge removing member comprises a charge removing brush mounted on the machine body to project into the guide groove.

7. The image forming apparatus according to claim 6, wherein the charge removing brush is connected to a grounding terminal provided on the machine body.

8. The image forming apparatus according to claim 1, wherein the charge removing member comprises a charge removing brush provided on the machine body for contact with the first terminal when the process cartridge is mounted at the cartridge mounting portion but before the first terminal comes into contact with the second terminal.

9. The image forming apparatus according to claim 8, wherein the charge removing brush is connected to a grounding terminal provided on the machine body.

10. The image forming apparatus according to claim 1, wherein the charge removing member is provided on the process cartridge for contact with a grounding terminal of the machine body when the process cartridge is mounted at the cartridge mounting portion but before the first terminal comes into contact with the second terminal.

11. The image forming apparatus according to claim 10, wherein the charge removing member comprises a charge removing brush.

12. An image forming apparatus comprising:

a machine body provided with a cartridge mounting portion;

a process cartridge removably mounted at the cartridge mounting portion for forming images on a recording paper;

a first terminal provided on the process cartridge;

a second terminal provided on the machine body for contact with the first terminal when the process cartridge is loaded at the cartridge mounting portion; and a charge removing member provided on the machine body for contact with the first terminal when the process cartridge is mounted at the cartridge mounting portion but before the first terminal comes into contact with the second terminal.

13. The image forming apparatus according to claim 12, wherein the machine body comprises a guide portion for guiding the first terminal when the process cartridge is mounted at the cartridge mounting portion, the charge removing member being provided in a travel path of the first terminal for contact therewith before the first terminal comes into contact with the second terminal.

14. The image forming apparatus according to claim 13, wherein the guide portion is formed to guide the first terminal downward when the process cartridge is mounted at the cartridge mounting portion, the charge removing member being positioned above the second terminal.

15. The image forming apparatus according to claim 13, wherein the guide portion is formed to guide the first terminal obliquely downward when the process cartridge is mounted at the cartridge mounting portion, the charge removing member being positioned above the second terminal.

16. The image forming apparatus according to claim 13, wherein the guide portion comprises a guide groove formed in a wall of the cartridge mounting portion.

17. The image forming apparatus according to claim 16, wherein the charge removing member comprises a charge removing brush mounted on the machine body to project into the guide groove.

18. The image forming apparatus according to claim 17, wherein the charge removing brush is connected to a grounding terminal provided on the machine body.

19. An image forming apparatus comprising:

a machine body provided with a cartridge mounting portion;

a process cartridge removably mounted at the cartridge mounting portion for forming images on a recording paper;

a first terminal provided on the process cartridge;

a second terminal provided on the machine body for contact with the first terminal when the process cartridge in loaded at the cartridge mounting portion; and a charge removing member provided on the process cartridge for contact with a selected conductive portion of the machine body when the process cartridge is mounted at the cartridge mounting portion but before the first terminal comes into contact with the second terminal.

20. The image forming apparatus according to claim 19, wherein the charge removing member comprises a charge removing brush, the selected conductive portion of the machine body comprising a grounding terminal.

* * * * *